United States Patent [19]

Daly et al.

[11] Patent Number: 4,941,131

[45] Date of Patent: Jul. 10, 1990

[54] FLUSH FOR FLUID MIXING AND DISPENSING SYSTEM

[75] Inventors: Robert E. Daly, Davidson; Clifford E. Sloan, Matthews, both of N.C.; Armisticio Z. Sanidad, Cherry Hill, N.J.

[73] Assignee: Picker International, Inc., Cleveland, Ohio

[21] Appl. No.: 362,886

[22] Filed: Jun. 7, 1989

[51] Int. Cl.[5] ..... B01F 15/02

[52] U.S. Cl. ..... 366/167; 134/168 R; 222/83; 366/172; 366/177

[58] Field of Search ..... 366/150, 166, 167, 172, 366/173, 151, 152, 153, 177; 134/167 R, 168 R; 222/83, 83.5, 85

[56] References Cited

U.S. PATENT DOCUMENTS

| | | | |
|---|---|---|---|
| Re. 30,610 | 5/1981 | Gacki et al. | 366/153 |
| 3,916,924 | 11/1975 | Gowan | 134/168 R |
| 3,990,909 | 11/1976 | Peckham | 134/168 R |
| 4,103,358 | 7/1978 | Gacki et al. | 366/153 |
| 4,197,942 | 4/1980 | Gacki et al. | 366/153 |
| 4,217,054 | 8/1980 | Gacki et al. | 366/150 |
| 4,227,818 | 10/1980 | Gacki et al. | 366/142 |
| 4,271,956 | 6/1981 | Brambley et al. | 206/219 |

*Primary Examiner*—Robert W. Jenkins

*Attorney, Agent, or Firm*—Watts, Hoffmann, Fisher & Heinke

[57] ABSTRACT

A film processing fluid mixing and dispensing apparatus is disclosed having means for flushing residual chemicals from surfaces of the apparatus. The apparatus has a reservoir for mixing chemicals and a structure for delivering water under pressure to the reservoir. The apparatus also includes several bottles each containing film processing chemical components. The bottles each have a mouth which is sealed with a piercable septum. A stationary template is provided for stationarily engaging and supporting the inverted bottles so that fluid from them drains into the reservoir. Movable piercers are provided for piercing the septa. The piercers are tubular. An elongated nozzle is fitted into each piercer core for delivering water under pressure to the inside of the reservoir and to the piercer surfaces. The nozzles are equipped with defusers to deliver the water in a divergent spray. The nozzles are held stationary, while the piercers are mounted for relative longitudinal movement with respect to the nozzles.

12 Claims, 4 Drawing Sheets

FLUSH FOR FLUID MIXING AND DISPENSING SYSTEM

BACKGROUND OF THE INVENTION

1. Field of the Invention

The present invention relates generally to a system and method for mixing and dispensing fluids used in processing x-ray film, and more particularly to apparatus and method for flushing residual film processing chemicals from portions of the mixing and dispensing system.

2. Prior Art

When a medical diagnosis is accomplished with x-ray examination, it is often desirable to complete the examination during a single visit of a patient to a diagnostic x-ray room. Recalling patient to repeat or supplement an examination is undesirable for a number of reasons. Time is lost in obtaining the information necessary for proper medical diagnosis. Repetition of some procedures such as those requiring catheter insertion can increase patient risk. Patient discomfort and anxiety can be quite acute if the patient is severely ill or uncomfortable. Inefficient utilization of the x-ray equipment can result from unnecessary repetitions of the procedures.

With modern medical diagnostic procedures it is often desirable to develop and preliminarily examine a radiograph while the patient remains at an exposure station in a diagnostic x-ray room. This enables the satisfaction of the attending physician that a given x-ray examination procedure has been successfully completed, or alternatively that, for some reason, it must be augmented by repetition or by a further radiographic procedure.

Where radiographs are to be inspected while a patient remains at an exposure station, fast film processing has come to be considered a vitally necessary part of medical x-ray diagnostic procedures. To achieve high rates of operation, film processors have been developed which automatically process an exposed sheet of x-ray film by mechanically feeding the sheet of film in sequence through baths of developer and fixer solutions, and then by washing and drying the film sheet. The time required for completely processing a radiograph is in the neighborhood of one and one half minutes or less.

Chemicals which perform the developing and fixing are consumed by use and degrade with time. With manual film processing, a skilled technician can compensate for depletion in solution concentrations by retaining films in the solutions for longer periods of time. With automatic processors, on the other hand, processing times are substantially constant and as a consequence, if solution concentrations are allowed to become depleted, the inevitable result is poor quality processing.

Accordingly, providing fast film processing of the requisite high quality and at the high volumes which are often encountered in busy hospitals depends on the continual provision of fresh, clean, and properly mixed chemicals. As the sheets of the film are transported through the baths, solution is carried away by the sheets and chemicals are consumed. Thus, fresh chemicals are required if desired processing quality is to be maintained and chemical replenishment is a necessity.

The developer and fixer solutions have relatively short shelf-lives; accordingly, it is desirable to mix the developer and the fixer solutions (1) near the location of the film processor and (2) at times immediately prior to the demand for them by the film processor.

In hospitals and clinics it is quite common for an attendant to mix the developer and fixer solutions manually. In this manual procedure the operator pours measured amounts of the chemical components and water into a mixing tank and then manually agitates the solution.

Manual mixing procedures have several drawbacks. Errors in proportioning the chemistry are common. Manual mixing is slow and messy. An attendant must maintain vigilance over the supplies of replenishment fluid in storage tanks.

In an attempt to alleviate these problems, the prior art has proposed chemical mixing systems which were intended to automatically mix developer and fixer solutions in proper concentrations and to dispense them to one or more film processors.

An automatic fluid mixing and dispensing system similar to the type into which the present invention is designed to be incorporated is described in U.S. Pat. No. 4,103,358, issued on Jul. 25, 1978 to Gachi, et al., and entitled "Fluid Mixing And Dispensing System". This patent is hereby expressly incorporated by reference.

In that patent, an improved technique for expeditiously mixing film processing chemicals is described wherein a plurality of bottles, each of a different size and containing a different film processing chemical, are used. The bottles include openings each sealed by a foil septum and which are accessible so that each bottle may be opened by piercing its foil septum.

According the '358 patent, the bottles, each containing a quantity of concentrated film processing chemical, are supported in an inverted orientation prior to piercing. The fluid mixing and dispensing system includes a plurality of tubular piercers with sharp ends pointing upwardly. Each piercer is aligned with the opening of a different one of the chemical containing bottles.

The piercers are vertically movable in ganged fashion by means of a piston mechanism attached to the piercers by way of a common supporting manifold. While the bottles are being positioned in their stationary inverted orientations prior to piercing, the piercers are in a lowered position such that they do not contact the foil septum of the bottles. After the bottles are positioned for opening, and opening is desired, the piston mechanism is actuated which raises the piercers so that each one penetrates the foil septum, or cover, which seals an unopened bottle.

After piercing, the chemicals within each bottle drain by gravity and are carried for mixing together in a common tank or reservoir, to which water is added, effecting agitation and desired dilution of the concentrated chemicals into a properly proportioned batch of fresh film processing chemical. This process, and apertures for carrying it out, is explained in detail in the incorporated '358 patent.

The system described in the '358 patent also included a rinse mechanism for directing water against a surface portion of the bottle supporting structure. See particularly the portions of the described system indicated at references characters 64 and 62 in the '358 patent.

The system into which the present invention is incorporated may optionally differ somewhat from the system of the '358 patent, in that the system described in the patent incorporated a carrier for holding the bottles, while the system into which the present invention is designed to be incorporated optionally does not utilize such a carrier. Rather, the system in which the present invention is embodied optionally relies upon a stationary template as a stationary apertured template for maintaining the bottles in a stable, inverted orientation prior to and after piercing.

While the system of the '358 patent has proven generally effective in accomplishing its purposes, a problem has arisen due to the tendency of some of the concentrated chemicals to remain in the bottles or to crystalize, about the piercer surfaces, causing them to adhere to the interior walls of the bottles and to the piercer surfaces. This results in incomplete emptying of the film processing chemicals from the bottles, undesirably weakening the concentration of the final mix. The crystalized material can also obstruct or restrict fluid flow through the hollow piercers, further limiting drainage of the chemicals from the bottles into the desired batch.

It is an object of this invention to provide a flush means and method for removing crystallized chemicals adhering to the interior surfaces of the bottles and to the surfaces and hollow cores of the tubular piercers, to facilitate complete discharge of all film processing chemicals from each bottle, and to minimize fouling of the fluid mixing and dispensing system by substantially eliminating crystalline deposits.

DISCLOSURE OF THE INVENTION

The disadvantages of the prior art are reduced or eliminated by a film processing fluid mixing and dispensing apparatus having means for flushing residual chemicals from surfaces of the equipment.

An embodiment of the invention includes a reservoir for mixing chemicals and means for delivering water under pressure to the reservoir. The system also includes a plurality of bottles each containing film processing chemical concentrate and having a mouth which is sealed with a piercable septum. A stationary template is provided for stationarily engaging and supporting one or more such bottles in an inverted orientation and at locations from which concentrated processing chemicals which drain from the bottles will be deposited in the reservoir. Movable piercers are provided for, upon actuation, piercing the septa and allowing the chemicals to drain from the bottles into the reservoir for mixing.

According to one aspect of the invention, means is also provided for directing a water spray into one or more of the bottles to flush crystalized or residual chemicals from the inner surfaces of the inverted bottles after piercing. The flushing means also causes water to flush and rinse surfaces of the piercers.

In accordance with a more specific feature, the means for delivering water to the interior of the bottles includes the piercers being configured in a tubular form defining a longitudinal hollow core, and an elongated nozzle fitted within the piercer core. The elongated nozzle is supplied with water by conduit means connecting it with the supply which delivers water under pressure to the reservoir. In this way, some of the water destined for the reservoir is used to rinse, or flush, the inside walls of the bottles and the surfaces of the piercers to eliminate fouling due to crystalline or residual chemicals, and to fully utilize all the chemicals originally present in the bottles.

In accordance with another more specific feature, the elongated nozzles are provided with flattened ends to effect a divergent water spray to cover with flushing water, substantially all the interior of the bottles.

In accordance with a still more specific feature, the elongated nozzles are coupled to structure for holding them stationary, while the piercers are movably mounted in a vertical direction substantially coaxially with the nozzles.

This invention will be better understood by reference to the following detailed description, and to the drawings, in which:

BRIEF DESCRIPTION OF THE DRAWINGS

FIG. 1(*b*) is a schematic view, on an enlarged scale relative to that of FIG. 1(*a*), of a mixing and dispensing unit utilized in the fluid mixing system of FIG. 1(*a*);

FIG. 2(*b*) is a side view, partly in section, of the piercer assembly of FIG. 2(*a*);

FIG. 2(*c*) is a perspective view showing the piercer assembly of FIGS. 2(*a*) and 2(*b*) mounted within a portion of the mixing unit;

BEST MODE FOR CARRYING OUT THE INVENTION

Figure 1A:
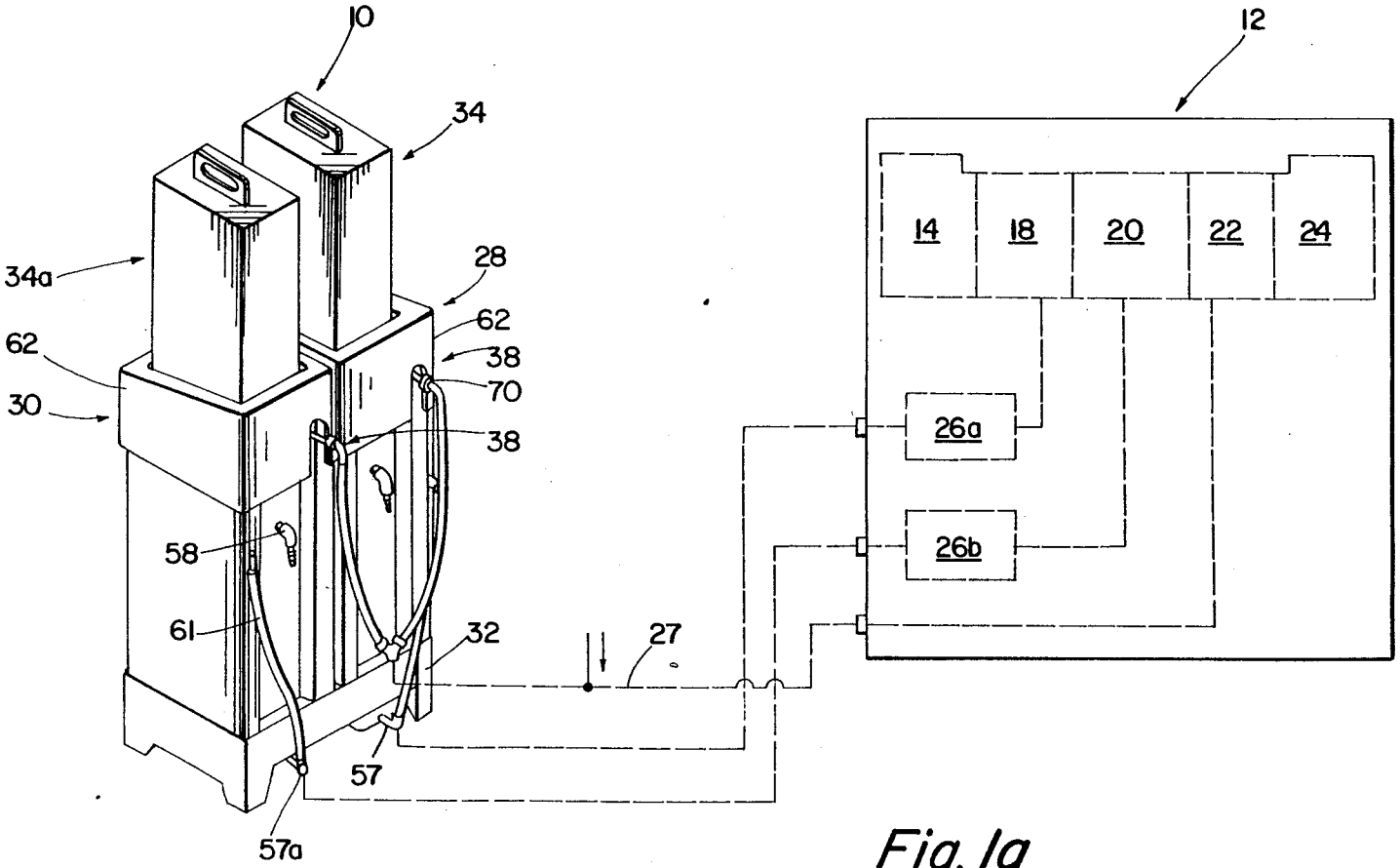
Fig. 1a (PRIOR ART)
FIG. 1(*a*) is a schematic view of a film processor and a prospective view of a fluid mixing system in which the present invention is incorporated.

In FIG. 1*a* a fluid mixing system is shown generally at 10. The system 10 is connected to a schematically illustrated x-ray film processor 12. The fluid mixing system 10 mixes and dispenses a fixer solution and a developer solution used by the film processor 12 in processing exposed sheets of film.

As shown schematically, the film processor 12 includes a film feeder 14 into which a collection of the exposed sheets of x-ray film is inserted for processing. The film is fed in a manner known in the art through developer, fixer, and rinse tanks 18, 20, 22, respectively. The processor 12 also includes a dryer 24 for completing the film processing.

Fluid pumps 26*a*, 26*b* are coupled to the developer and fixer tanks 18, 20 and to the mixing system 10. The pumps 26*a*, 26*b* supply the tanks 18, 20 with developer and fixer solutions from the mixing system 10 for maintaining the strength and volume of the solutions in the tanks 18, 20 as they are depleted during the processing of the film. A water line 27 supplies water to the rinse tank 22 and to the mixing system 10.

The fluid mixing system 10 is comprised of a developer mixing unit 28 for mixing and dispensing the developer solution to the developer tank 18, and a fixer mixing unit 30 which mixes and dispenses the fixer solution to the fixer tank 20. A base 32 is provided for supporting the developer and fixer mixing units 28, 30.

Figure 1B:
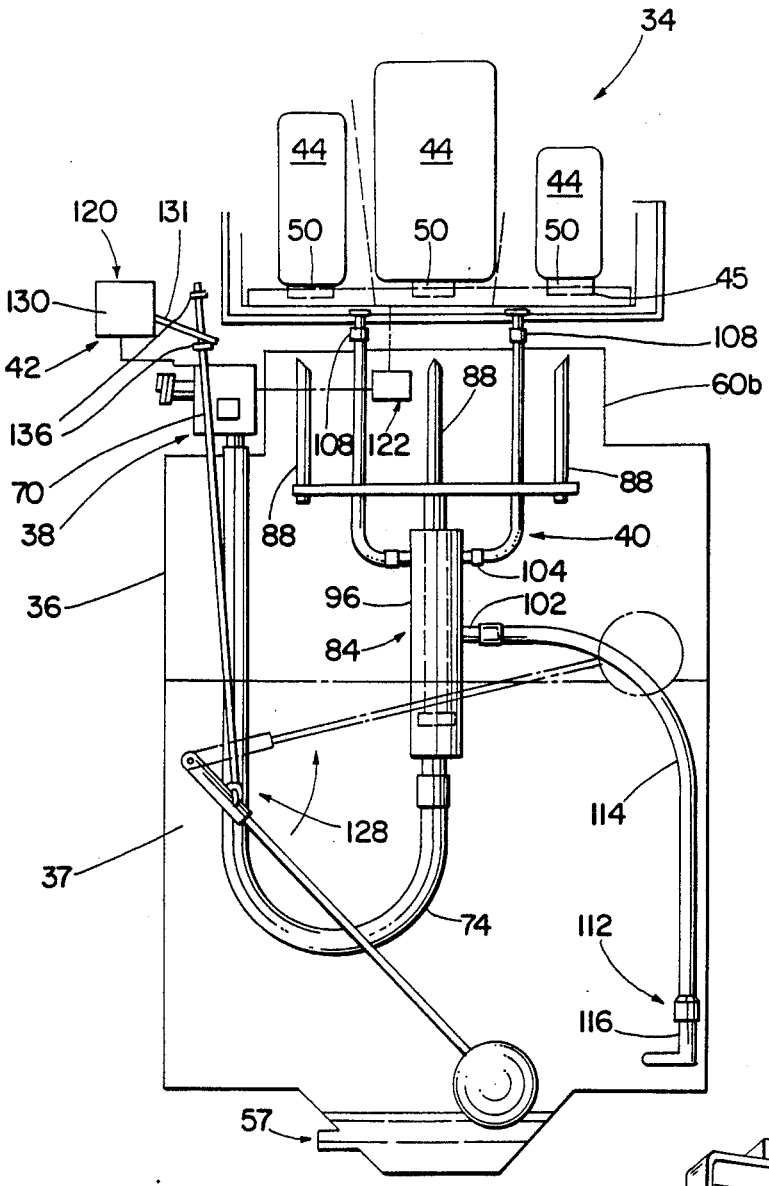

The developer mixing unit 28 is schematically illustrated in FIG. 1*b*. The mixing unit 28 uses a developer chemical supply 34 which includes containers of chemicals which, when diluted with water, produce the developer solution. The unit 28 includes a tank structure 36 which supports the developer chemical supply 34. The tank structure defines a reservoir 37 under the chemicals supply 34 in which the developer solution is mixed.

A water input mechanism 38 is connected to a tank structure 36 for coupling a source of pressurized water to the tank structure 36 to provide a source of pressurized water for the reservoir. A fluid release assembly 40 is disposed in the tank structure and is coupled to the water input mechanism 38. The fluid release assembly 40 is operated by water under pressure to release the developer chemicals and allow them to flow into the reservoir 37.

A control apparatus 42 is also disposed within the tank structure 36. The control apparatus 42 functions to operate the water input mechanism 38 and the fluid release assembly 40.

Conditioned upon (1) the developer chemical supply 34 having a predetermined amount of the containerized developer chemical, and (2) the developer solution within the reservoir 37 failing to a predetermined level, the control apparatus 42 operates the water input mechanism 38 to actuate the fluid release assembly and introduce a fresh supply of water into the reservoir.

Operating the release assembly 40 with water which is introduced only upon the actual introduction of water through the mechanism 38 is a feature which provides fail-safe operation. If the control apparatus 42 malfunctions or if pressure in the water line 27 is low, the mixing unit 28 will not operate. This substantially eliminates chances for mixing improper concentrations of the solution.

One arrangement of the developer chemical supply 34 is shown in FIG. 1*b*. One or more inverted vessels in the form of bottles 44 are supported in an inverted position over reservoir 37. For purposes of illustration, three associated bottles of conventional three-part developer chemical are shown. Two of the bottles are of a relatively small size, and the third bottle is of a relatively larger size.

Each bottle 44 is plastic and has a neck 45. A protecting cap covers a thin, centrally located, mouth-sealing septum 50 (where shown). Each septum is sealed to the neck of its bottle. The cap may or may not have a central aperture. The septum 50 is piercable through an apertured cap or after removal of a nonapertured cap to release the developer chemical contained in the bottle 44.

The water input mechanism 38 underlies the support structure 62 and is secured to the upper housing portion 60*b*. The mechanism 38 is comprised on a water valve assembly 70 which is coupled to the pressurized source by the water line 27. The water valve assembly 70 is operated by the control apparatus 42 for introducing the pressurized water into the tank structure 36. A water line 74 is coupled between the valve assembly 70 and the fluid release assembly 40. The line 74 provides water for powering the fluid release assembly 40 and for introducing water into the reservoir 37 through the release assembly 40.

Figure 2C:
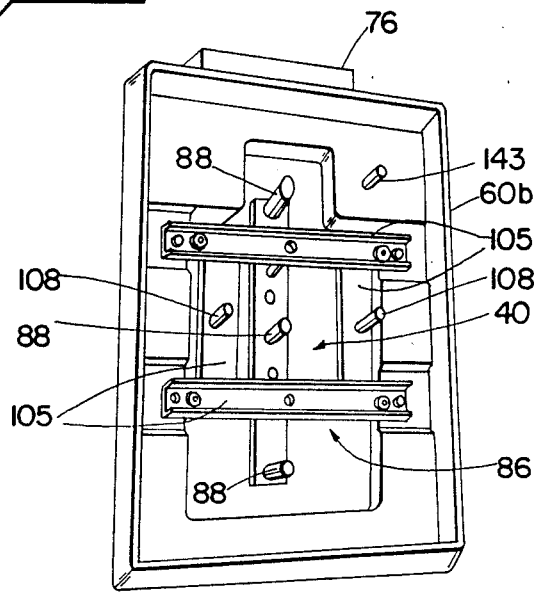
FIG. 2(*a*) is an end view of a piercer assembly which forms part of the system of FIG. 1(*b*)
Figure 2A:
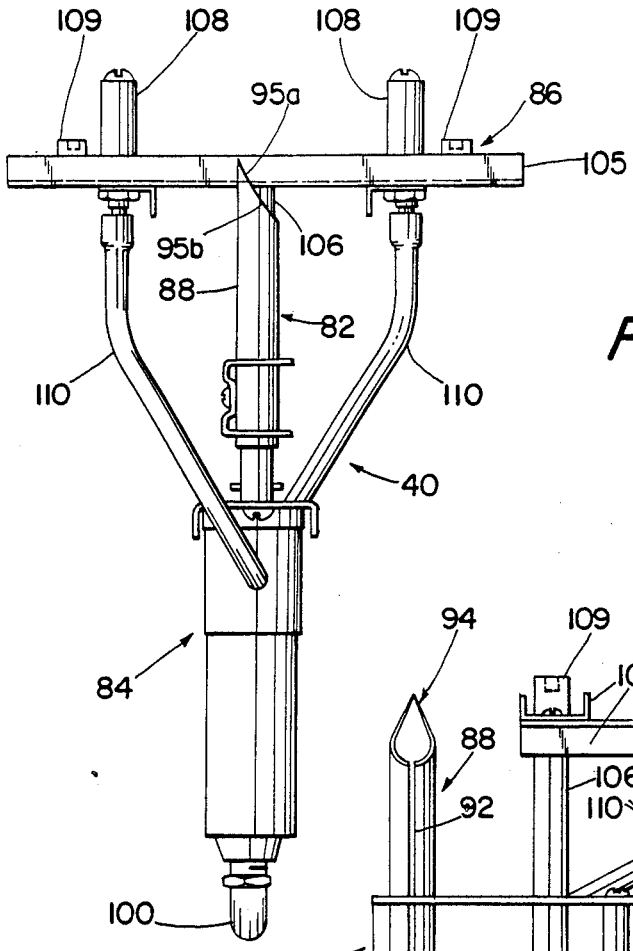
Figure 2B:
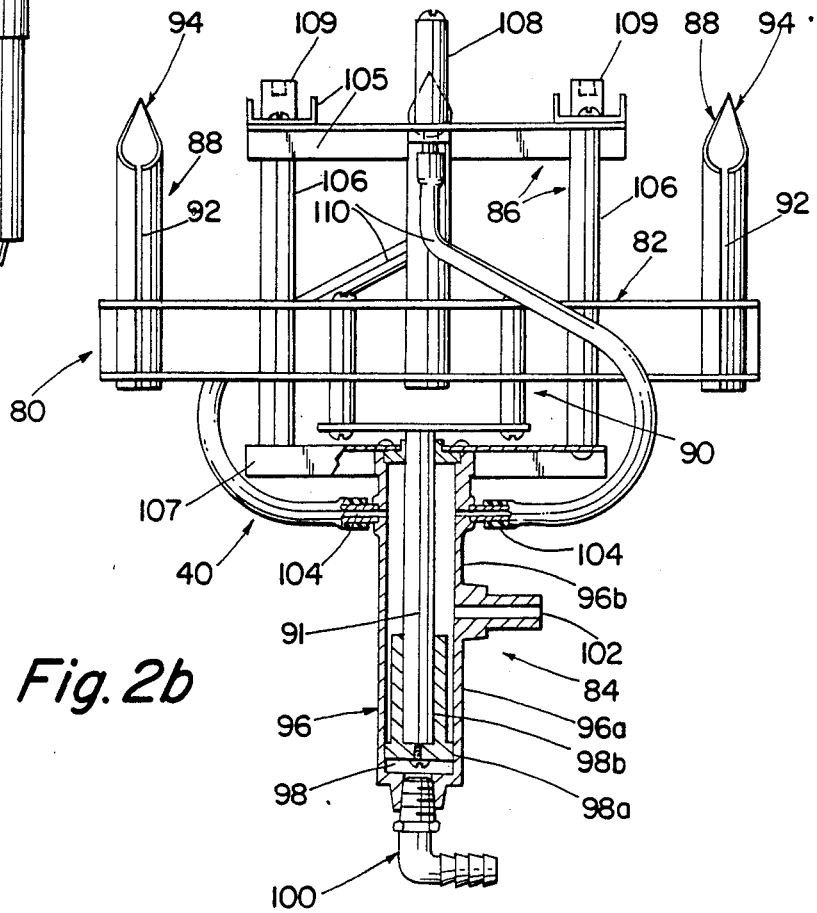

The fluid release assembly 40 is shown in detail FIGS. 2*a*, 2*b*. The release assembly includes a movable piercer assembly 80 having a piercing subassembly 82. A drive subassembly 84 is connected to the piercer subassembly to cause selective movement of the piercer. The piercer is guided along a rectilinear path by a support and guide structure 86. The piercing subassembly 82 is operable, when driven, to pierce the septum 50 of each positioned bottle 44.

The movably supported piercing subassembly 82 has a set of three tubular piercers 88 and piercer support 90. The piercers 88 are supported in alignment for rupturing the septums 50.

Each of the piercers 88 is a metal tube having a pointed end portion 94. The pointed end portion 94 is a feature which assures piercing of the septums 50 without coring. This is advantageous because coring could produce a severed piece of septum material which could become lodged in one of the metal tubes and obstruct drainage to the reservoir 37. A severed piece of septum can cause other problems such as, passing into the reservoir 37 and plugging the outlet 57.

The pointed end 94 of each piercer 88 is formed by a cut-away section which defines a slicing edge portion 95*a* and a fold-over edge portion 95*b*. The slicing portion 95*a* is the upper portion of the piercer 88 and includes the tip. The fold-over portion 95*b* is the lower portion of the section and defines the side of the piercer 88 opposite the tip.

The slicing portion 95*a* is an efficient piercer and has an edge which clearly slices the septum 50. It is defined by an edge which is formed at a relatively small angle with the axis of the piercer. In the preferred embodiment this angle is thirty degrees from the axis.

The fold-over portion 95*b* is an inefficient piercer which tends to push, tear and fold over the septum 50 without completely severing a piece of the septum. The fold-over portion 95*b* is defined by an edge which is formed at a larger angle to the tube axis than the angle of the slicing portion 95*a*. In the preferred embodiment, the angle of the fold-over portion is forty-five degrees.

A longitudinal slit 92 extends along the length of each piercer 88 and intercepts the fold-over portion 95*b*. The slit 92 is formed during manufacture of each piercer 88, as the tube is formed by rolling a flat sheet. The slit 92 assists in preventing coring of the septum 50 by guaranteeing that a link of septum remains connected between the severed edge of the septum and the remaining septum.

The drive subassembly 84 has a hollow cylinder 96 which is secured to the guide structure 86. A water-driven piston 98 is reciprocally mounted in the cylinder 96 and is fixed to the rod 91. A connector assembly 100 connects the cylinder 96 to the water line 74 for introducing a piston-actuating supply of water into the cylinder 96.

The piston 98 includes a head portion 98*a* and a hollowed cylindrical portion 96*b* which receives and is secured to the rod 91. As the piston 98 is advanced by water pressure from the introduction of water through the input mechanism 38, the rod 91, and thus the piercing subassembly 82 and the piercers 88 are advanced for piercing the positioned septa.

The hollow cylinder 96 has a piston chamber composed of a lower, cylindrically contoured, piston drive portion 96*a* and an upper, flared, piston bypass portion 96*b*. The lower portion 96*a* cooperates with the head 98*a* of the piston for defining a substantially watertight seal so that the piercers are driven up forcefully when water is first introduced through the connector assembly. The flare of the upper portion 96*a* when the piston 98 is advanced into the upper portion 96*b*.

The cylinder 96 has an output port 102 and a set of rinse ports 104. The output port 102 is at the beginning of the flare of the upper portion 96*b* and directs water into the reservoir 37 after the piston 98 has been advanced beyond the port 102 and into the flared upper portion 96*b*. The rinse ports 104 are in the upper portion 96*b* and receive the water which bypasses the head 98*a* when the piston 98 is in the upper portion 96*b*.

The support and guide structure 86 includes four straps 105 secured together in a generally rectangular configuration, as seen in FIG. 2*c*. The straps 105 are secured to the upper housing 60*b*. A pair of guide posts 106 are secured to the straps 105, and a piece of stainless channel 107 supports the guide posts 106 from the cylinder 96. The guide posts 106 guide the piercer support 90 as it is advanced by the piston 98. A plurality of threaded mounts 109 are secured to the straps 105 for mounting the structure 62 by means of screws.

The system for delivering fluid (water) under pressure to the tank or reservoir as a function of reservoir fluid level, and in coordination with piercer operation, is explained in full detail in U.S. Pat. No. 4,103,358, which is above in its entirety incorporated expressly by reference. This patent also describes fully the electrical control system and its relation and interfacing with fluid supply and piercer operation apparatus.

A rinse mechanism is mounted to the guide structure 86. The rinse mechanism directs water onto the recessed upper surface 64 of the container support structure 62 for rinsing the surface 64 of chemicals and for initiating premix of the chemicals with water. The rinse mechanism comprises a set of spray heads 108 and a pair of hoses 110 coupling the spray heads 108 to the rinse ports 104. The spray heads 108 extend from the support and guide structure 86 through spray head apertures 108*a* formed through the container support 62.

An agitator assembly 112 is provided as a feature which facilitates mixing. The agitator 112 directs the water introduced through the output port 12 under pressure into a relatively rapid stream which creates an agitating swirl within the reservoir 37. The agitator assembly 112 includes a hose 114 coupled to the output port 102 and a water jet mechanism 116 coupled to the hose 114 for producing the fast-moving stream of water and creating the agitating swirl.

Figure 3:
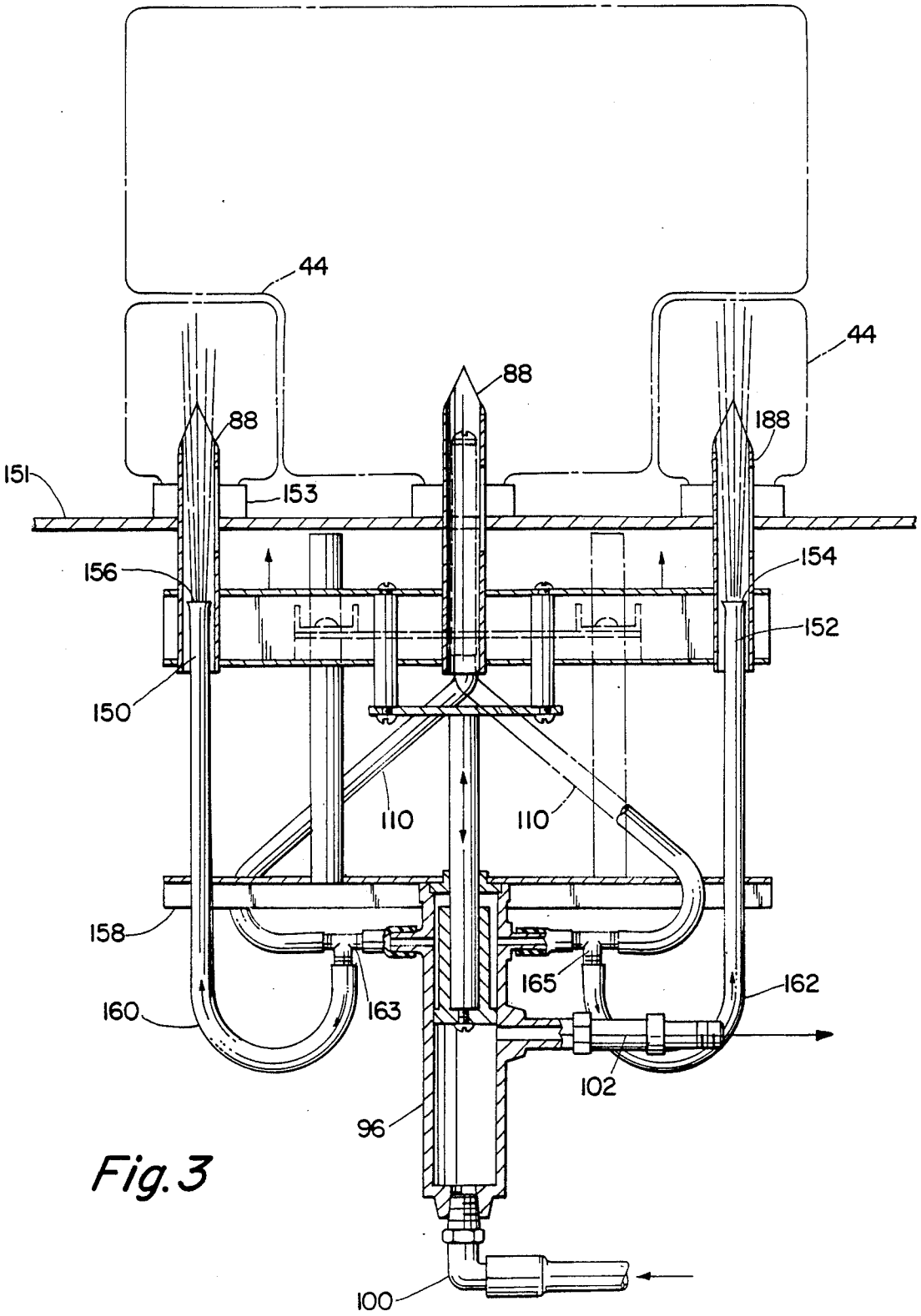
FIG. 3 is an elevational view, partly in section, illustrating the specific structure of apparatus embodying the present invention as incorporated in the mixing unit shown in the previously described Figures.

FIG. 3 illustrates the portion of the mixing and dispensing system shown in FIG. 2(*c*), but modified to incorporate apparatus embodying the present invention. For convenient understanding and correlation between the two Figures, certain major parts shown in FIG. 3 have been labeled with reference characters corresponding to those used on the analogous parts in FIG. 2(*c*).

As can be seen, FIG. 3 illustrates in general form the chemical concentrate containers or bottles 44 and piercers 88. The bottles, rather than being mounted within a carrier, such as shown in the drawing of FIG. 1(*a*), are instead engaged, in an inverted orientation, in respective openings of a template 151. Each opening is defined by a collar, such as at 153. Each template opening engages with and accommodates the neck of an inverted bottle. The location of each template opening is such that, when the neck of a bottle is inverted and engaged in the opening, it is aligned for piercing generally coaxially with a respective one of the piercers 88.

The piercers are movable in a vertical direction by means similar to that shown and described in connection with FIGS. 2(*b*) and 2(*c*).

An elongated nozzle is fitted coaxially within two of the piercers 88. The elongated nozzles are designated by reference characters 150, 152. Each elongated nozzle extends through a portion of the hollow core of the respectively associated piercer. If desired, the elongated nozzles could extend further upwardly, through substantially the entire piercer.

The end of each nozzle 150, 152 is preferably flattened, as indicated at reference characters 156, 154 in order to provide a spray head which in turn provides a divergent or diffuse spray into the interior of the associated bottle 44 when fluid is provided passing upwardly through the nozzle. Such a spray is incident upon the interior walls of the associated bottle 44, and serves to rinse, or flush, the interior of the bottle in order to remove crystalline chemicals which may remain after the bulk of the chemical concentrate has already drained from the bottle. Additionally, the spray impinges upon and serves to rinse or flush the surfaces, both interior and exterior, of the piercer itself. Spraying can take place with the piercer in either its raised or lowered position relative to the bottle.

In the embodiment of FIG. 3, the elongated nozzles 150, 152 are sized such that fluid from the bottles, after piercing the septum has occurred, can flow downwardly through the space defined by the outer circumferential surface of the elongated nozzle and the inner surface of the tubular piercer. Fluid flowing downwardly in this manner is delivered to the reservoir in a manner analogous to that described in connection with the system of the above incorporated '358 patent.

Fluid is furnished to each elongated nozzle 150, 152 by means associated with the apparatus for delivering water under pressure to the mixing tank or reservoir. FIG. 3 illustrates the port 102 through which water from the pressurized water supply system is directed to the reservoir in a manner similar to that disclosed in connection with the description of FIG. 2(*c*).

In the embodiment, however, of FIG. 3, a portion of the water which would otherwise by destined for flow to the rinse system is diverted from hoses 110 and hoses 160,162, by way of trees 163, 165.

Each of these hoses 160,162 carries water, in a direction shown by the arrows in FIG. 3, transversely and then upwardly to the bottom ends of the respective elongated nozzles 150, 152. It is this pressurized flow of some of the water from the pressurized water delivery means which provides the spraying action previously described in connection with FIG. 3.

By the apparatus shown in the embodiment of FIG. 3, the invention provides a mixing system having a means for flushing the interior of the concentrate bottles and the surfaces of the piercers themselves, to minimize or eliminate fouling which can occur because of the accumulation of residual or crystalline material left by the concentrated film processing chemicals. Additionally, the removal of the residual and crystalline material to the reservoir assures that the entirety of the chemicals available in the concentrate in fact finds its way into the final mix of solution, enhancing the accuracy of concentration in that final mix.

It is to be understood that this specific description is intended as illustrative, rather than exhaustive, of the invention. It is to be understood that persons of ordinary skill in the relevant art can make certain additions or modifications to, or deletions from, the described specific embodiments, without departing from the spirit or the scope of the invention, as set forth in the appended claims.

We claim:

1. A system for mixing first and second fluids, said system comprising:

(a) a reservoir;

(b) a container containing a quantity of said first fluid, said container defining an opening and having a piercable septum sealing said opening;

(c) means for supporting said container in an orientation wherein said first fluid is in contact with the inner side of said septum;

(d) a movable tubular piercer mounted for piercing said septum in response to movement of said piercer;

(e) means for causing piercer movement to pierce said septum and to thereby release said first fluid for drainage from said container;

(f) means for directing said first fluid draining from said container into said reservoir;

(g) means for delivering a second fluid to said reservoir;

(h) means for directing some of said second fluid through said tubular piercer and into said container for flushing of said container and of surfaces of said piercer.

2. The system of claim 1, wherein:

said means for delivering some of said second fluid to said container comprises a tubular nozzle extending at least partially through the interior of said tubular piercer.

3. The system of claim 2, wherein said means for delivering some of said second fluid through said tubular piercer comprises conduit means in communication with said means for delivering said second fluid to said reservoir.

4. The system of claim 2, wherein:

said tubular nozzle defines a flattened end for effecting a divergent spray.

5. In a system for automatically mixing film processing chemical solution, the system including a reservoir, a vessel containing a quantity of film processing chemical and defining an opening covered by a piercable septum, means for stationarily supporting the vessel at a discharge station with the septum in a downward facing orientation, a piercer assembly for opening the vessel by piercing the septum to allow the contents of the vessel to drain into the reservoir, and means for delivering a second fluid to the reservoir, said improvement comprising:

means for delivering a quantity of said second fluid to flush the interior of said vessel and to flush surfaces of said piercer as well, while the vessel is located at said discharge station.

6. The improvement of claim 5, wherein said means for flushing comprises:

(a) said piercer defining a tubular configuration with a hollow core extending longitudinally through said piercer;

(b) an elongated nozzle extending through at least a portion of said hollow core of said piercer, and (c) conduit means coupled between said elongated nozzle and said second fluid delivering means.

7. The improvement of claim 6, further comprising:

said elongated nozzle defining a flattened portion proximate its end most facing the interior of said vessel.

8. A system for mixing a solution of film processing chemical, said system comprising:

(a) a reservoir;

(b) a bottle containing a quantity of a first fluid and defining a mouth covered by a piercable sealing septum;

(c) means for stationarily supporting said bottle at a holding station and in an inverted orientation with its sealed mouth facing downwardly and positioned such that fluid if allowed to drain from said mouth will pass to said reservoir;

(d) an elongated tubular piercer defining an elongated hollow core extending longitudinally within the piercer, said piercer being located aligned with and below said septum when said bottle is positioned at said holding station;

(e) means for moving said piercer in a substantially upward direction to pierce the septum and allow said first fluid to drain from said bottle;

(f) an elongated stationary nozzle fitted within said hollow core of said tubular piercer;

(g) means for delivering a second fluid to said reservoir;

(h) conduit means communicating between said elongated stationary nozzle and said means for supplying said second fluid to pass some of said second fluid through said elongated nozzle and incident upon the interior surface of said bottle.

9. The system of claim 8, further comprising:

said elongated nozzle being configured at one end to effect a divergent spray about the interior of said bottle.

10. A method for flushing material from within a film processing fluid mixing system, the system including a reservoir, a bottle-like vessel for holding a first fluid to be mixed and being sealed by a piercable septum, means for holding the vessel at a location, means for piercing the septum while the vessel is at said location, and means for delivering a second fluid to the reservoir, said method comprising the steps of:

delivering said second fluid incident upon interior surfaces of said vessel while at said location to effect flushing of residual chemicals from said container.

11. The method of claim 10, wherein said step of delivering fluid to the interior walls of the container comprises delivering fluid through a portion of said piercer.

12. The method of claim 11, wherein said delivering step comprises transmitting some of said second fluid from said second fluid delivery means through said piercer.

* * * * *